United States Patent [19]

Hooker

[11] 4,431,188

[45] Feb. 14, 1984

[54] BALL TYPE GAME APPARATUS WITH LATERALLY MOVABLE BALL STRIKING MECHANISM AND CONTROL THEREFOR

[75] Inventor: Donald E. Hooker, Wilmette, Ill.

[73] Assignee: Bally Manufacturing Corporation, Chicago, Ill.

[21] Appl. No.: 264,582

[22] Filed: May 18, 1981

[51] Int. Cl.[3] ..... A63F 7/02; A63F 7/26

[52] U.S. Cl. ..... 273/121 A; 200/61.11; 273/129 S

[58] Field of Search ..... 273/119 A, 121 A, 122 A, 273/129 S, 121 R, 121 D, 121 E, 124 R, 124 A, 119 R, 85 R, 85 C, 85 F; 200/61.11, 61.1

[56] References Cited

U.S. PATENT DOCUMENTS

| | | | |
|---|---|---|---|
| 1,252,957 | 1/1918 | Schuyler | 273/121 R |
| 1,942,880 | 1/1934 | Rockola | 273/121 E |
| 2,024,851 | 12/1935 | Frohne | 273/121 A |
| 2,037,108 | 4/1936 | Bechtol | 273/121 R |
| 2,048,944 | 7/1936 | Munro | 273/85 R |
| 2,094,673 | 10/1937 | Rudolph | 273/121 R |
| 2,160,299 | 5/1939 | Zinngrabe | 273/85 R |
| 2,184,866 | 12/1939 | Radtke | 273/119 A |
| 2,200,190 | 5/1940 | Plouvier | 273/121 A |
| 2,362,188 | 11/1944 | Clark | 273/89 |
| 2,378,983 | 6/1945 | Conwell | 273/124 R |
| 2,402,274 | 6/1946 | Clarke | 273/185 D |
| 2,507,258 | 5/1950 | Kohler | 273/85 C |
| 2,551,698 | 5/1951 | Pearl et al. | 273/121 A |
| 2,610,058 | 9/1952 | Hooker | 273/121 A |
| 2,872,193 | 2/1959 | Hamilton | 273/119 A |
| 2,962,287 | 11/1960 | Canivet | 273/119 A |
| 3,404,888 | 10/1968 | Lally et al. | 273/121 A |
| 3,448,982 | 6/1969 | Griggs | 273/119 A |
| 3,627,318 | 12/1971 | Garbary et al. | 273/121 A |
| 3,746,341 | 7/1973 | Reisinger | 273/121 A |
| 3,785,650 | 1/1974 | Halliburton | 273/110 |
| 3,910,580 | 10/1975 | Leonhart | 273/119 A |
| 3,997,163 | 12/1976 | Cooper et al. | 273/121 A |
| 4,189,150 | 2/1980 | Langieri | 273/121 A |

*Primary Examiner*—Richard T. Stouffer
*Attorney, Agent, or Firm*—Welsh & Katz

[57] ABSTRACT

A ball striking mechanism for use in an amusement game machine of the type which has an inclined playfield and at least one ball that moves on the playfield. The striking mechanism is mounted for lateral movement relative to the inclined playfield and is adapted to strike the ball and propel it along the playfield when properly laterally positioned to intercept the ball. In the preferred embodiment, the striking mechanism is activated by the ball. The mechanism is laterally positioned by operator manipulation and the mechanism includes a shock absorbing mechanism which prevents excessive energy applied to the handle from being transmitted to the internal mechanism to thereby protect the same from damage.

21 Claims, 20 Drawing Figures

BALL TYPE GAME APPARATUS WITH LATERALLY MOVABLE BALL STRIKING MECHANISM AND CONTROL THEREFOR

This invention generally relates to amusement game machines, and more particularly, to a ball striking mechanism for use in an amusement game machine of the type which has an inclined playfield and a ball that moves on the playfield.

Amusement game machines of the type which have a ball that moves along an inclined playfield have employed shooting or kicking mechanisms that are of two general types. One type of mechanism kicks the ball when the ball contacts the mechanism and closes an electrical switch. The other type, generally called a "flipper", has a pivoting ball striking arm which is activated by a player depressing a push button switch.

The present invention comprises a ball striking mechanism which is different from the above in that it can be moved laterally by the player to intercept the ball as it travels on the playfield and which, in its preferred embodiment, is automatically activated when the ball touches it. The mechanism has a kicking or contacting surface that is convexly curved which permits a skillful player to control the ball trajectory by accurately laterally positioning the kicker mechanism during play.

The lateral positioning of the kicking mechanism is performed by layer manipulation of a pivoting handle on the game machine cabinet. By moving the handle between two extreme positions, the kicking mechanism is laterally positioned between its two extreme positions. The mechanism has the capability of absorbing excessive acceleration that may be produced by an overzealous player, with the absorption of the energy being effective to prevent damage to internal portions of the mechanism. A kicking arm which strikes the ball is located above the playfield, but all other components of the mechanism are located below the playfield. The mechanism is constructed so that the ball will not fall through the playfield during play; because there is a portion of a panel adjacent a kicker arm mechanism that moves with the mechanism and provides a generally continuous playfield surface in the area of the kicker arm mechanism.

Accordingly, it is an object of the present invention to provide an improved ball striking mechanism for an amusement game machine, which has a kicker arm that may be moved laterally by the player to intercept and also aim the ball toward a target.

Another object of the present invention is to provide an improved ball striking mechanism of the foregoing type which has a kicker arm that can be laterally moved by a player manipulating a handle outside of the game machine cabinet, which mechanism is automatically activated by the ball touching it.

Yet another object of the present invention is to provide an improved ball striking mechanism of the foregoing type wherein the mechanism includes means for absorbing excessive energy supplied by rapid handle movement, to thereby protect the mechanism from damage.

Other objects and advantages will become apparent upon reading the following detailed description, while referring to the attached drawings, in which.

DETAILED DESCRIPTION OF THE INVENTION

Figure 1:
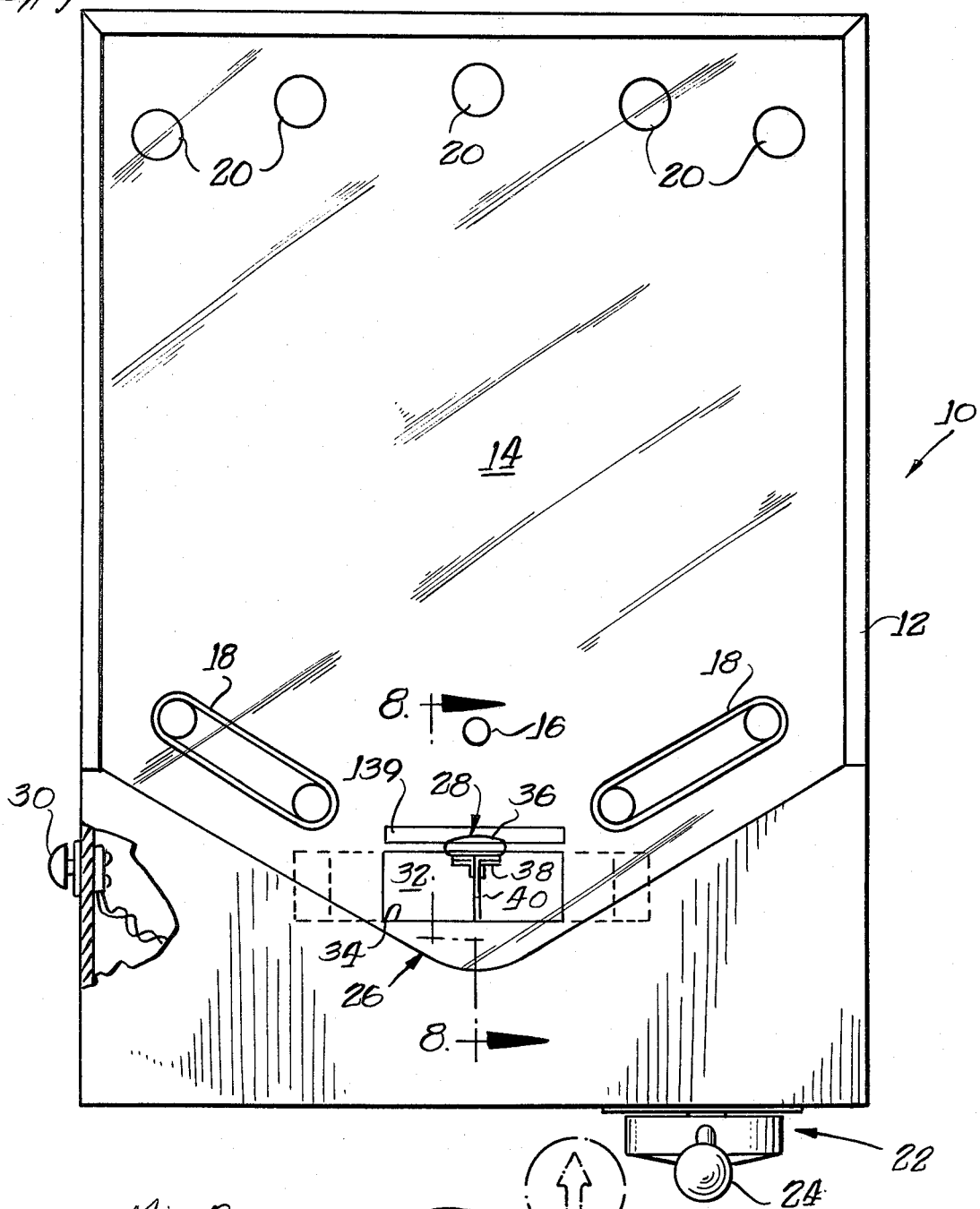
FIG. 1 is a plan view of an amusement game machine employing the ball striking mechanism of the present invention.

Broadly stated, the present invention comprises a ball striking mechanism which can be used in an amusement game machine of the type which has an inclined playfield and a ball which is put into play and which is attempted to be maintained on the playfield during play of the game by the player. At the lower portion of the playfield is an opening through which the ball may roll and be lost if it is not intercepted by the ball striking mechanism of the present invention.

The ball striking mechanism has a kicker arm mechanism that is capable of being laterally moved and positioned by player manipulation for the purpose of intercepting the ball and the ball kicker arm mechanism is actuated to propel the ball upwardly into the playfield and thereby maintain the ball in play, preferably so as to accumulate a point score. The lateral positioning of the ball kicker arm mechanism is controlled by a handle control mechanism that is preferably located on the front of the machine. It may be in the form of a handle that is moved left and right, which movement controls the lateral position of the ball kicker arm mechanism in the lower portion of the playfield. An alternate embodiment has the handle located on the side of the machine, and the handle may be moved forwardly and back to control the lateral position of the ball kicker arm mechanism. The handle control mechanism is operatively attached to a laterally movable carriage mechanism which carries the ball kicker arm mechanism which is adapted to strike the ball when it is properly laterally positioned.

The surface of the kicker arm mechanism which contacts the ball is preferably convexly curved so that the precise position in which the ball is struck will determine the trajectory of the ball up into the playfield. More specifically, the curved surface, coupled with the direction from which the ball came when it contacts the striking surface determines the direction in which the ball is propelled upwardly into the playfield, so that a skillful player can accurately laterally position the ball striking mechanism and thereby effectively aim or control the trajectory of the ball so as to hit the most desirable targets for the purpose of accumulating a larger point score on the amusement game machine. It should be appreciated that since the speed of the ball is often quite fast, a significant amount of skill is involved in accurately positioning the mechanism to produce not only the desired trajectory, but to intercept the ball and maintain it in play. Because the play of the amusement game machine can be very rapid, quick reflexes and fast, accurate movement of the handle control mechanism is desirable if not necessary.

The ball striking mechanism of the present invention also includes means for absorbing excess energy applied to the handle control mechanism during play so as to protect the mechanism from damage. In the preferred embodiment, the ball kicker arm mechanism is automatically activated, preferably by the ball completing an electrical circuit which causes the ball to be propelled upwardly as soon as it contacts the striking surface of the ball kicker mechanism.

Turning now to the drawings, and particularly FIG. 1, an amusement game machine 10 is shown to have a cabinet 12 and a playfield 14 that is inclined or sloped so that a ball 16 will roll from the top of the drawing as shown to the bottom thereof. The machine has bumpers 18 for contacting the ball during its downward travel and a number of lighted switches 20 which will advance the point score when struck by the ball during play of the game. The ball striking mechanism of the present invention generally comprises the handle control mechanism indicated generally at 22 and having a handle 24, a laterally movable carriage mechanism 26 and a ball kicker arm mechanism 28, portions of each of which are visible in FIG. 1.

More particularly, the handle control mechanism 22 has the handle 24 located on the front side of the cabinet which may be moved rightwardly from the position shown for the purpose of laterally moving the carriage mechanism 26 and the ball kicker arm mechanism 28 in the opening defined by the two bumpers 18 for the purpose of intercepting the ball 16 to maintain it in play. When the ball 16 contacts the ball kicker arm mechanism 28, it will be actuated to propel the ball upwardly into the playfield. Although the kicker arm mechanism 28 is preferably automatically activated in response to the ball contacting the kicker mechanism, an alternate embodiment may have a switch 30 preferably located on the opposite side of the cabinet which can be activated by the player to cause the kicker arm mechanism to move upwardly and strike the ball to propel it upwardly into the playfield.

Although the ball 16 may be lost during play due to the failure of the player to properly position the kicker arm mechanism 28 so as to intercept the ball and propel it upwardly to maintain it in play, the portion of the laterally movable carriage mechanism 26 that is visible in FIG. 1 has a generally continuous panel 32 that is moved within an opening 34 in the playfield and the panel 32 is generally at the same elevation as the surface of the playfield so that if the ball is not intercepted by the kicker arm mechanism 28 it will roll across the panel 32 to a location where the ball can be shot upwardly into the playfield for another play of the machine. In other words, even though the ball kicker arm mechanism 28 is laterally movable, there is no opening in the playfield through which the ball can be lost.

Figure 2:
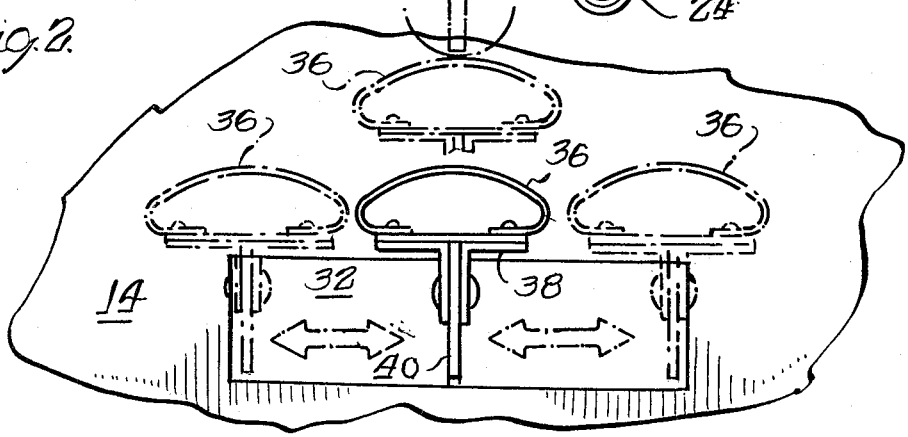
FIG. 2 is an enlarged diagrammatic view of a portion of the striking mechanism of FIG. 1, with the lateral positions of the range of movement shown in phantom.
Figure 9:
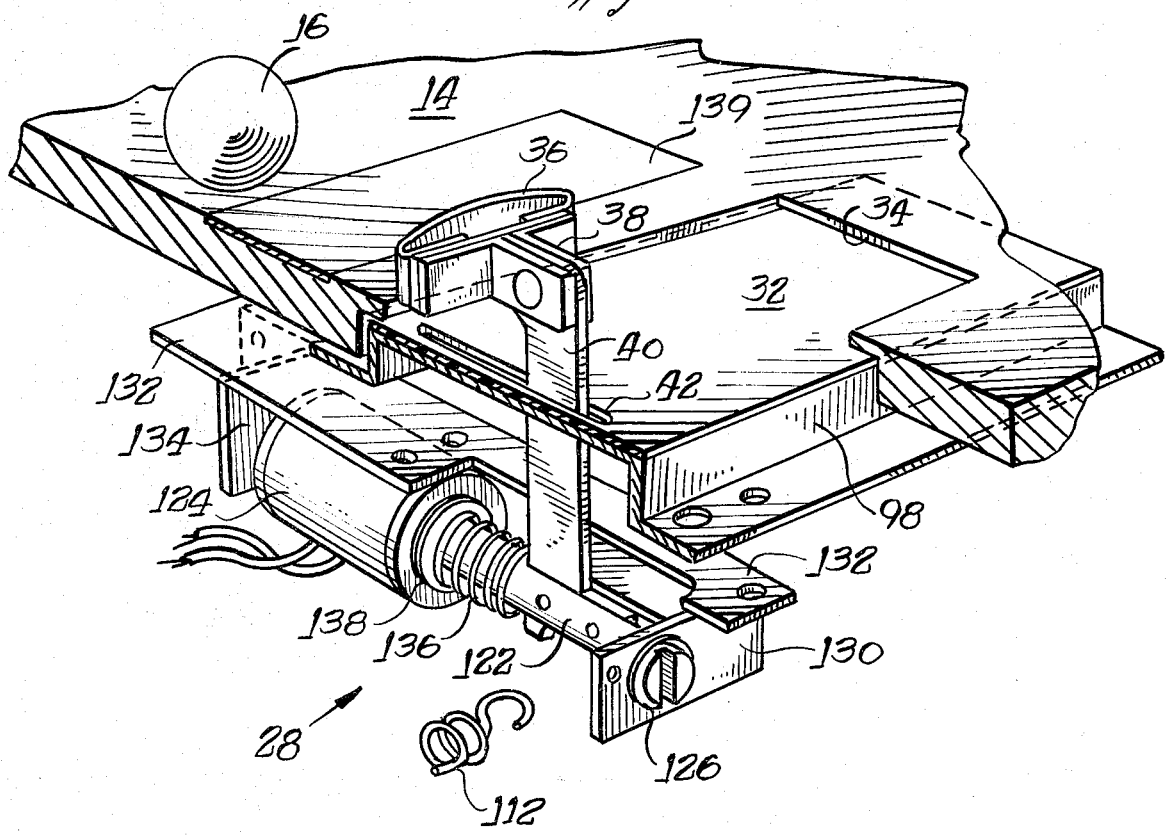
FIG. 9 is an enlarged exploded fragmentary perspective view of the kicker arm mechanism of the apparatus shown in FIGS. 1 and 8.

As shown in FIGS. 1 and 2, the ball kicker arm mechanism 28 has a convex front surface 36, preferably comprised of a resilient steel band that is attached to a generally T-shaped bracket assembly 38 that is also attached to a kicker arm 40 that extends through a slot 42 (see FIGS. 9 and 11) in the plate 32, which arm extends to the remainder of the ball kicker arm mechanism 28 that is located beneath the playfield. In other words, the only portion of the ball kicker arm mechanism 28 that extends above the surface of the playfield comprises the components that are shown and have been described in FIGS. 1 and 2. Although the steel band is preferred, it should be appreciated that the striking surface 36 may be fabricated of rubber or other resilient material. The steel band is preferred because it forms a part of an electrical circuit that will be hereinafter described. When the kicker arm mechanism 28 is actuated, it moves quickly upwardly as shown in FIGS. 1 and 2 with sufficient force to rapidly propel the ball 16 upwardly into the playfield. It should be appreciated that the curved surface 36 will enable the ball to be propelled straight up or to the right or left depending on the lateral position of the surface 32 relative to the ball at the point of contact. Thus, a skillful player will be able to laterally position the kicker mechanism so as to propel the ball in the direction that is desired, which will preferably be toward the target that will provide him with the most advantage in terms of accumulating point score, bonuses or the like.

Figure 3:
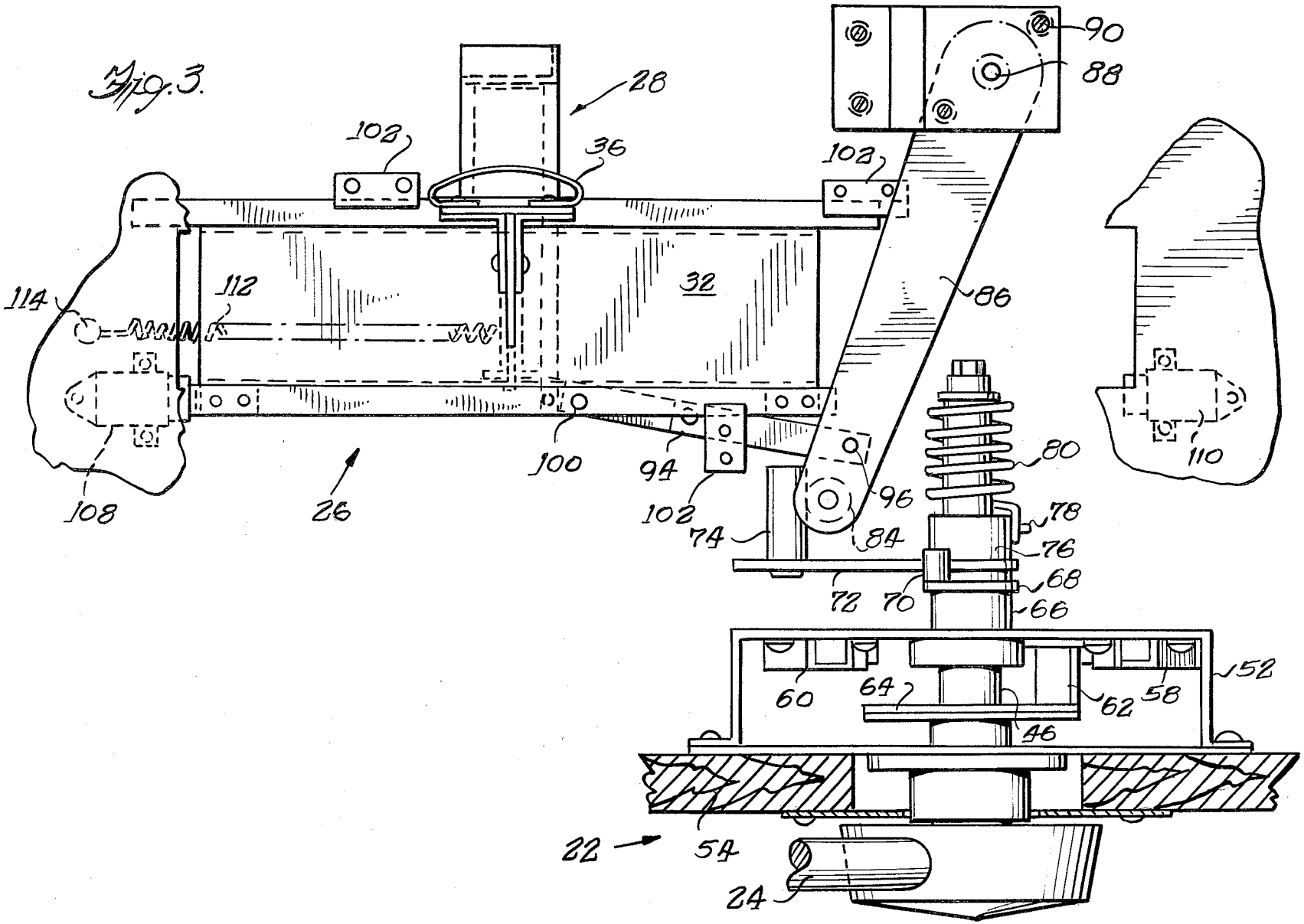
FIG. 3 is a fragmentary plan view of the mechanism of FIG. 1, shown with the playfield removed and particularly illustrating the kicker arm mechanism with the striking surface in its extreme left position.
Figure 6:
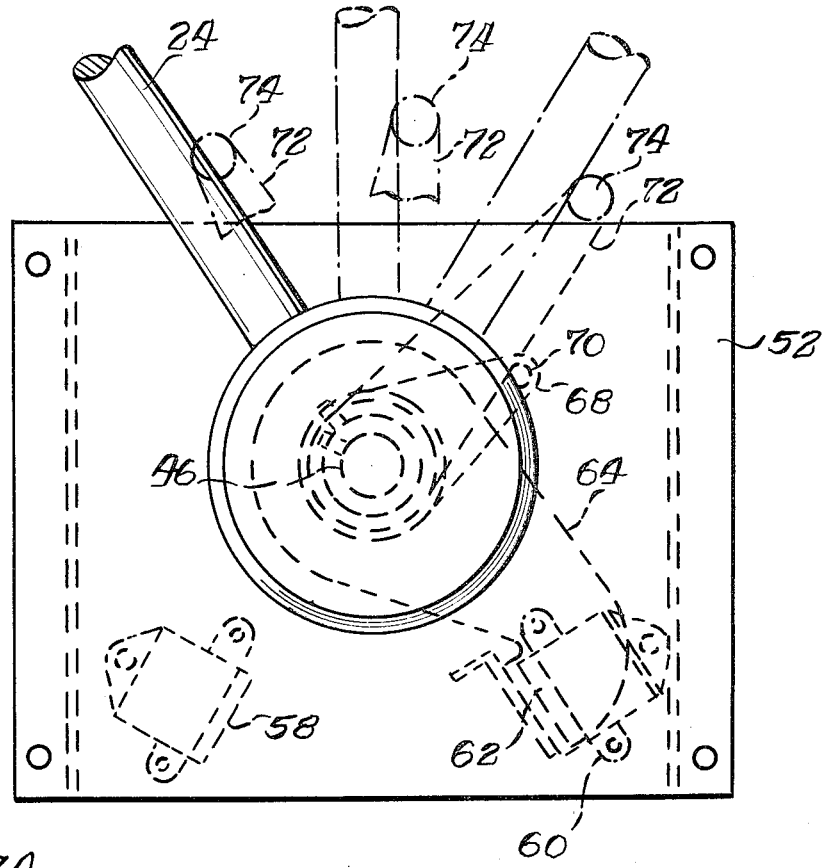
FIG. 6 is an enlarged fragmentary front elevational view taken from the right front corner of FIG. 1 with the cabinet removed, showing the control handle mechanism in a position corresponding to the striking surface being in the extreme left position, and in positions in phantom corresponding to the center and extreme right positions.
Figure 7A:
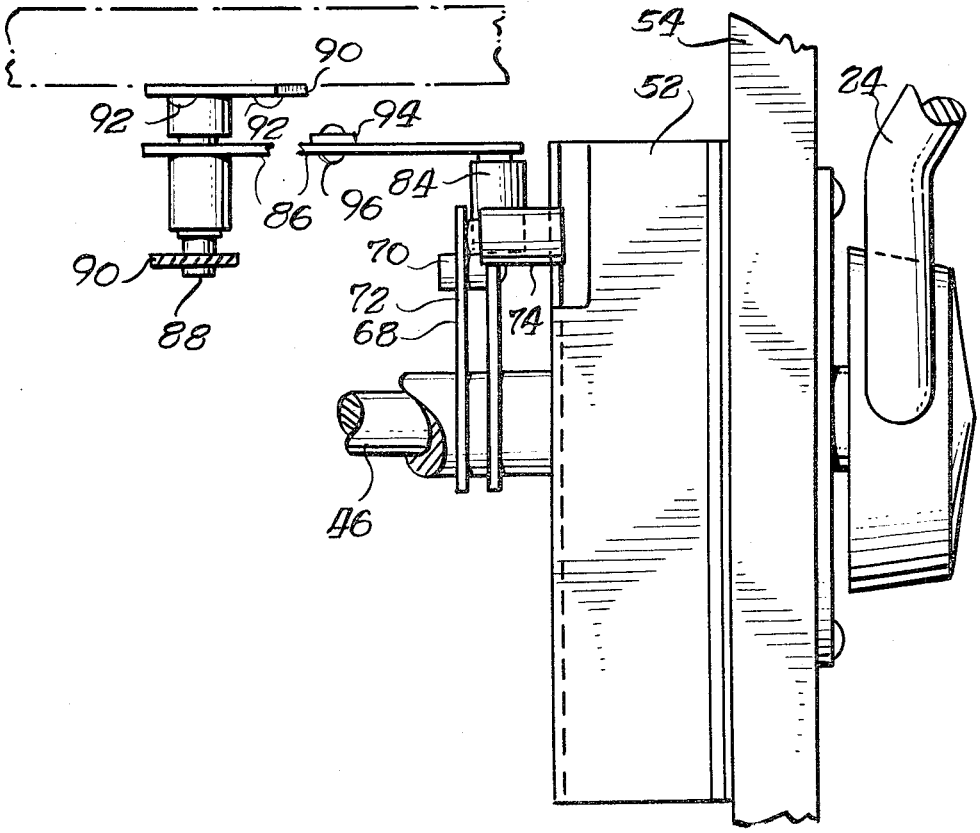
FIG. 7A is a side elevation of the control handle mechanism of FIG. 3.
Figure 7E:
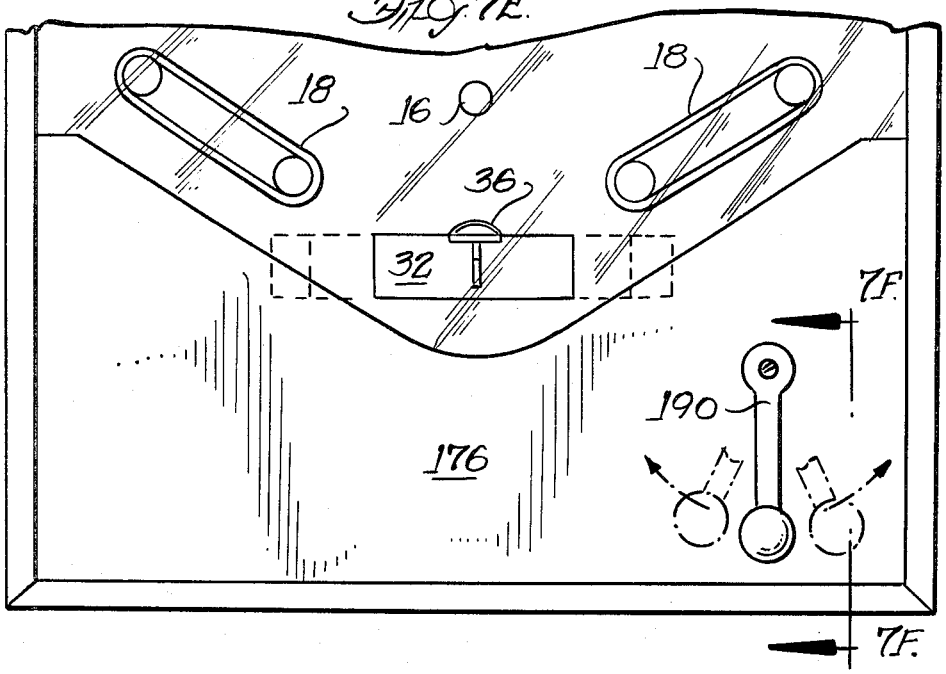
FIG. 7E is a top view of the handle control mechanism for use with the mechanism of FIGS. 7C and 7D and is shown mounted to a panel that is located above the playfield.

In accordance with an important aspect of the present invention, the interaction between the handle control mechanism 22 and the laterally movable carriage mechanism 26 which carries the ball kicker arm mechanism 28 will now be described in connection with FIGS. 3, 4, 5 and 7A. As is best shown in FIGS. 3 and 7A, the handle control mechanism 22 moves in a generally vertical plane, whereas the laterally movable carriage mechanism 26 moves in a generally horizontal plane and a mechanism interaction of the two mechanisms translates movement of the handle 24 into lateral movement by the kicker arm mechanism 28. The handle control mechanism 24 will initially be described in connection with FIGS. 3 and 6 although this mechanism is also partially shown in FIGS. 4, 5 and 7A.

The handle 24 is attached to a shaft 46 that is journaled in bushings 48 and 50 that are in turn mounted to a housing 52 by well known means, with the housing 52 being securely mounted to the sidewall 54 of the cabinet which has an opening 56 therein through which the mechanism can pass. The handle 24 is movable between two extreme positions that are determined by stop bumpers 58 and 60 located within the housing 52 which interact with a transverse stop plate 62 that is rigidly attached to a plate 64 that is in turn attached to the shaft 46. Thus, the handle 24 may be moved between the extreme positions shown in FIG. 6 which are determined by the arcuate movement of the stop plate 62 between the stop bumpers 58 and 60.

The shaft 46 also has a sleeve 66 attached to it by a set screw 67 or the like and to an arm 68 which carries a rotatable roller 70 that engages a longer arm 72 that carries yet another roller 74 for engagement with the laterally movable carriage mechanism 26 as will be hereinafter described. The arm 72 is secured to a sleeve 76 that is freely rotatable relative to the shaft 46. The sleeve 76 has a radially extending pin 78 for engaging one end of a spring 80, the other end of which bears upon a pin 82 that is secured to the shaft 46. Thus, the spring 80 is biased to urge the pin 78 in a counterclockwise direction as viewed from the free end of the shaft 46, i.e., the top of the drawing of FIG. 3. The spring forces the sleeve 76 and arm 72 toward roller 70 and they will be biased into contact with one another during normal operation. Thus, it is seen that arcuate movement of the handle 24 will result in similar arcuate movement of the arm 72 and roller 74 as is desired.

The roller 74 engages the laterally movable carriage mechanism 26 and causes it to laterally move as the arm 72 and roller 74 move. This is accomplished by a roller 84 positioned to engage roller 74 since the two are at right angles relative to one another. The roller 84 is mounted to a pivotable elongated crank 86 that pivots around pivot pin 88 that is secured to the underside of the playfield 14 by means of a bracket 90 that is attached thereto by screws 92 or the like. The intermediate portion of the crank 86 is attached to a link 94 by means of a pin 96 and the opposite end of the link 94 is attached to a carriage plate 98 by means of another pin 100. The plate 98 has a generally U-shaped cross section (see FIG. 9) and the flat plate 32 is attached to the top side thereof, with the plate 32 being visible through the opening 34 in the playfield as has been previously described with respect to FIG. 1.

The carriage plate 98 is mounted for lateral movement, i.e., left and right as shown in FIG. 3, in response to pivoting movement of the crank 86 around the pin 88. The carriage plate 98 has three plastic sloted guides 102 which support the carriage plate and permit it to move laterally between its left and right extreme positions. The carriage plate 98 has L-shaped bracket members 104 and 106 attached at opposite ends thereof for engaging respective stop bumpers 108 and 110 which limit the extent of movement in the left and right directions, respectively.

The plate 98 is biased in the leftward direction as shown in FIG. 3 by means of a spring 112 that has one end attached to a bracket 114 that is attached to the underside of the playfield by pins 116 or the like. The opposite end of the spring 112 is operatively attached to the plate 98 via a flange 118. The spring 112 urges the plate 98 to the left which in turn biases the link 94 and crank plate 86 leftward or clockwise around the pivot pin 88 and also thereby biases the roller 84 into contact with roller 74. Thus, as the handle 24 is slowly moved through the entire arc of its travel, the carriage plate 98 will accordingly be moved, since the spring 112 biases the pivotable crank so that its associated roller 84 is in continuous contact with the roller 74 of the handle control mechanism.

In accordance with an important aspect of the present invention, the interaction of the handle control mechanism with the laterally movable mechanism 26 is such that excess energy applied to the handle 24 will be absorbed to thereby prevent the laterally movable carriage mechanism from being damaged. This is accomplished in different ways by the mechanism depending upon the direction of movement of the handle.

Figure 4:
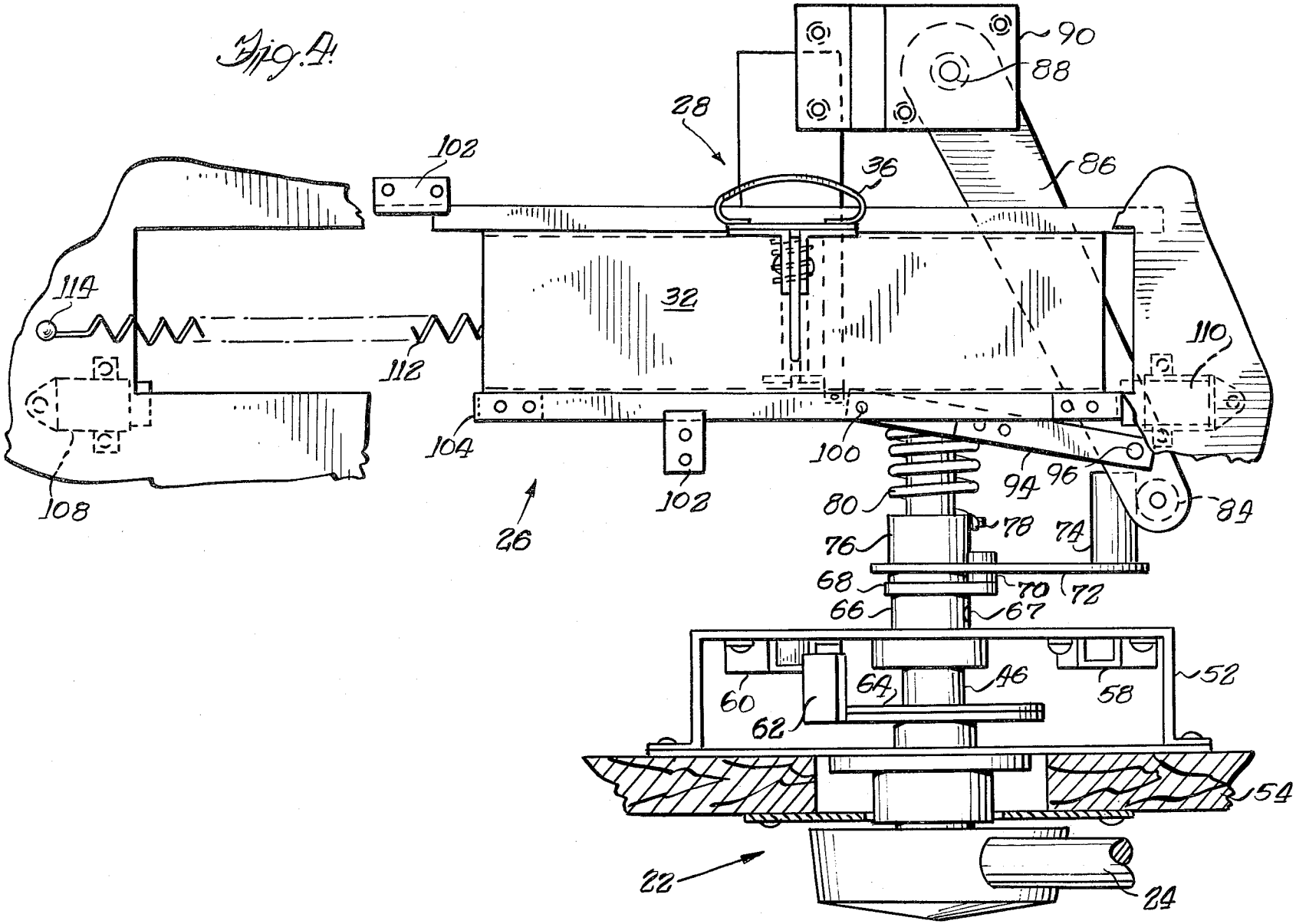
FIG. 4 is a view of a portion of the striking mechanism, similar to FIG. 3, but showing the striking surface in its extreme right position.

In the first case and referring to FIG. 4 where the laterally movable carriage mechanism is in its extreme right position and the handle 24 is pushed to the right by the player, the crank 86 is in the illustrated position. When it is in this position and the handle is moved rapidly toward the left as shown in FIGS. 3 and 4, the roller 74 will be moved rapidly leftwardly. The excess energy applied to the handle will merely result in the roller 74 separating from the roller 84 so that excess energy will never be applied to the laterally movable carriage mechanism. The maximum speed in which the laterally movable carriage mechanism will move to the left is determined solely by the strength of the spring 112 and not by the speed with which the handle 24 is pulled.

However, when the handle is rapidly moved in the opposite direction, the excess energy is absorbed in a different way. Thus, referring to FIG. 3, if the handle 24 is moved from the position as shown rapidly toward the right as shown in the drawing, the excess energy is absorbed by the spring 80. This is accomplished because the energy which moves the arm 72 and roller 74 is translated through the spring 80. Excessive energy will cause the arm 68 and roller 70 to separate from the arm 72 and roller 70. While the energy that passes through the spring 80 reaches the laterally movable carriage mechanism 26 by virtue of the contact between the rollers 74 and 84, the maximum force that reaches the roller 84 is determined solely by the strength of the spring 80 and it is chosen so that the maximum energy that reaches the laterally movable mechanism is well below that which would damage the mechanism.

In accordance with yet another important aspect of the present invention, the ball kicker arm mechanism 28 that is carried by the laterally movable carriage mechanism 26 will now be described. As best shown in FIGS.

8 and 9, it has the arm 40 extending upwardly above the surface of the playfield 14 and has attached to it the T-shaped bracket assembly 38 to which the steel band defining the convex surface 36 is attached. The arm 40 extends through the slot 42 in the plate 32 as well as through a wider slot 120 located in the plate 98 so that the arm 40 is not in electrical contact with the plate 98 for reasons that will be hereinafter described. The arm 40 is attached to a plunger 122 of a solenoid coil 124. The plunger 122 has an insulating sleeve 126 at its outer end which is set in an opening 128 of a transverse extension 130 of a bracket 132 that has another transverse bracket 134 at its opposite end to which the solenoid coil 124 is attached. The bracket 132 is attached to carriage plate 98 by rivets 135 or the like. A compression spring 136 is carried by the plunger 122 and bears against a preferably plastic electrically insulating, but nonmagnetic sleeve 138 that is positioned inside the body of the solenoid coil 124 and against the near side of the arm 40 so as to bias the plunger away from the solenoid coil, i.e., to the right shown in FIG. 8.

Figure 11:
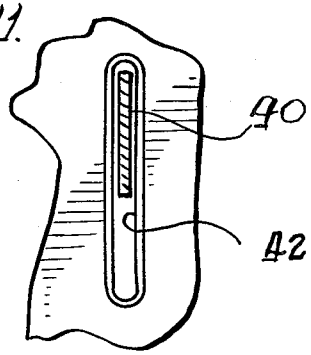
FIG. 11 is an enlarged bottom view of a portion of the carriage mechanism shown in FIGS. 1, 3, 8 and 9; and, FIG. 12 is an electrical schematic diagram of circuitry which may be used with the kicker arm mechanism of the present invention.
Figure 10:
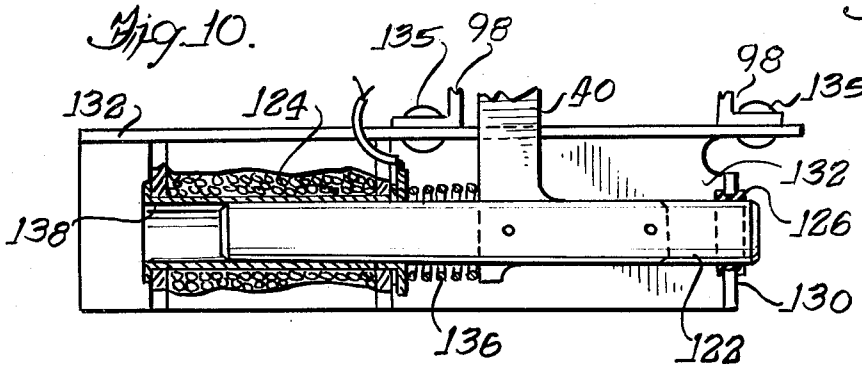
FIG. 10 is an enlarged side elevation, partially in cross section, showing a portion of the kicker arm mechanism shown in FIGS. 1, 8 and 9.
Figure 8:
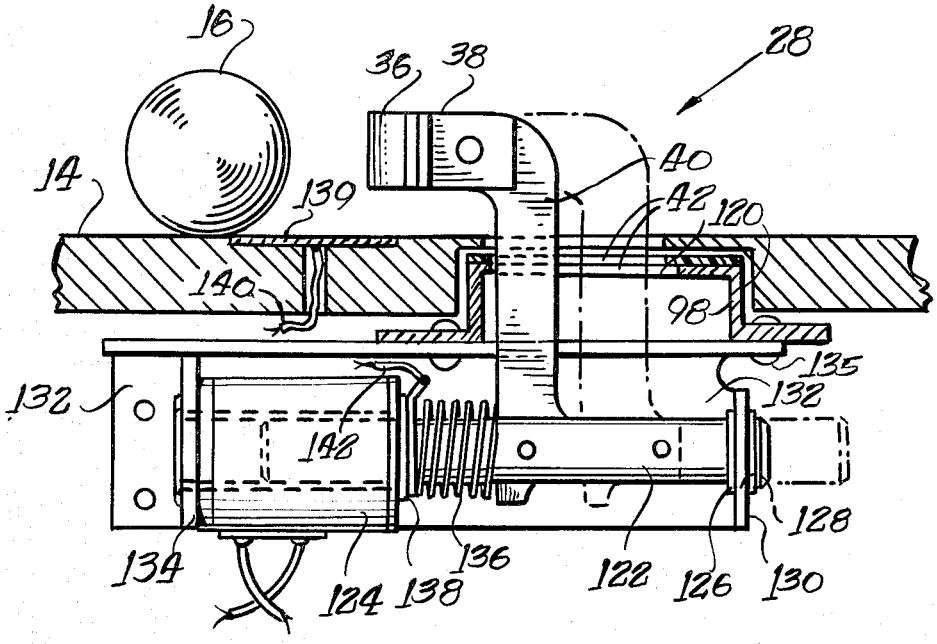
FIG. 8 is an enlarged vertical section of a portion of the kicker arm mechanism shown in FIG. 1 and is taken generally along the line 8—8 of FIG. 1.

It should be appreciated that when the solenoid is energized, the plunger is pulled into the solenoid coil 124 which causes the surface 36 to be propelled to the left as shown in FIG. 8 and thereby propel the ball 16 to the left or upwardly into the playfield as shown in FIG. 1. The plastic sleeve 138 electrically isolates the plunger 122, spring 136, arm 40 and surface 36 from any other metallic bracket or component shown in FIGs. 8 and 9. As best shown in FIG. 11, the purpose of the slot 42 in the plate 32 which is comprised of an electrically insulating material being narrower than slot 120 in the carriage plate 98 is to prevent electrical contact of the metallic arm 40 with the plate 98. A metallic plate 139 is placed in a suitable recess in the surface of the playfield 14 and is connected to a circuit that will be hereinafter described via electrical conductor 140, which together with conductor 142 enable the circuitry which activates the solenoid coil 124 to operate. The plate 139 extends the full width of travel of the ball kicker arm mechanism so that it will be activated when the ball is intercepted anywhere within the extreme left and right positions. When the ball 16, which is preferably comprised of steel, contacts the kicker surface 36 and the plate 139, an electrical circuit is closed which will cause the solenoid coil 124 to be energized and the ball will be propelled upwardly to the playfield.

Figure 12:
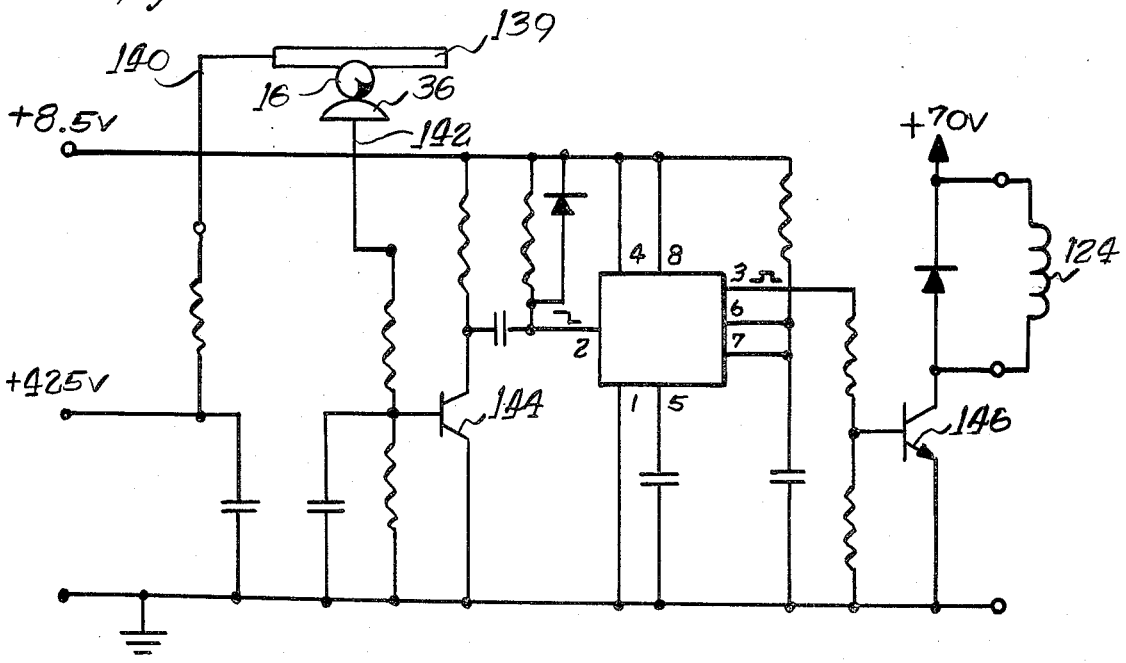

A conventional circuit that may be used to operate the solenoid coil 134, utilizing the ball 16 and the surface 36 and plate 139 that are connected to the conductors 140 and 142 is shown in FIG. 12. The circuitry diagrammatically shows the conductors 140, 142 as well as the surface 36, ball 16 and plate 139. When the ball is in the position illustrated, then voltage present on line 140 will be applied to the base of a transistor 144 through a voltage divider to obtain a voltage level compatible with the transistor to place it into conduction which will result in a negative-going pulse being applied to pin 2 of a 555 integrated circuit timer which is connected to function as a one-shot multivibrator. As such, a pulse will be provided at pin 3 thereof which will be applied to the base of a transistor 146 and will place it into conduction for the duration of the pulse, which will result in the coil 124 being energized for that time period. This will cause the solenoid to be actuated and propel the ball upwardly into the playfield.

Figure 3A:
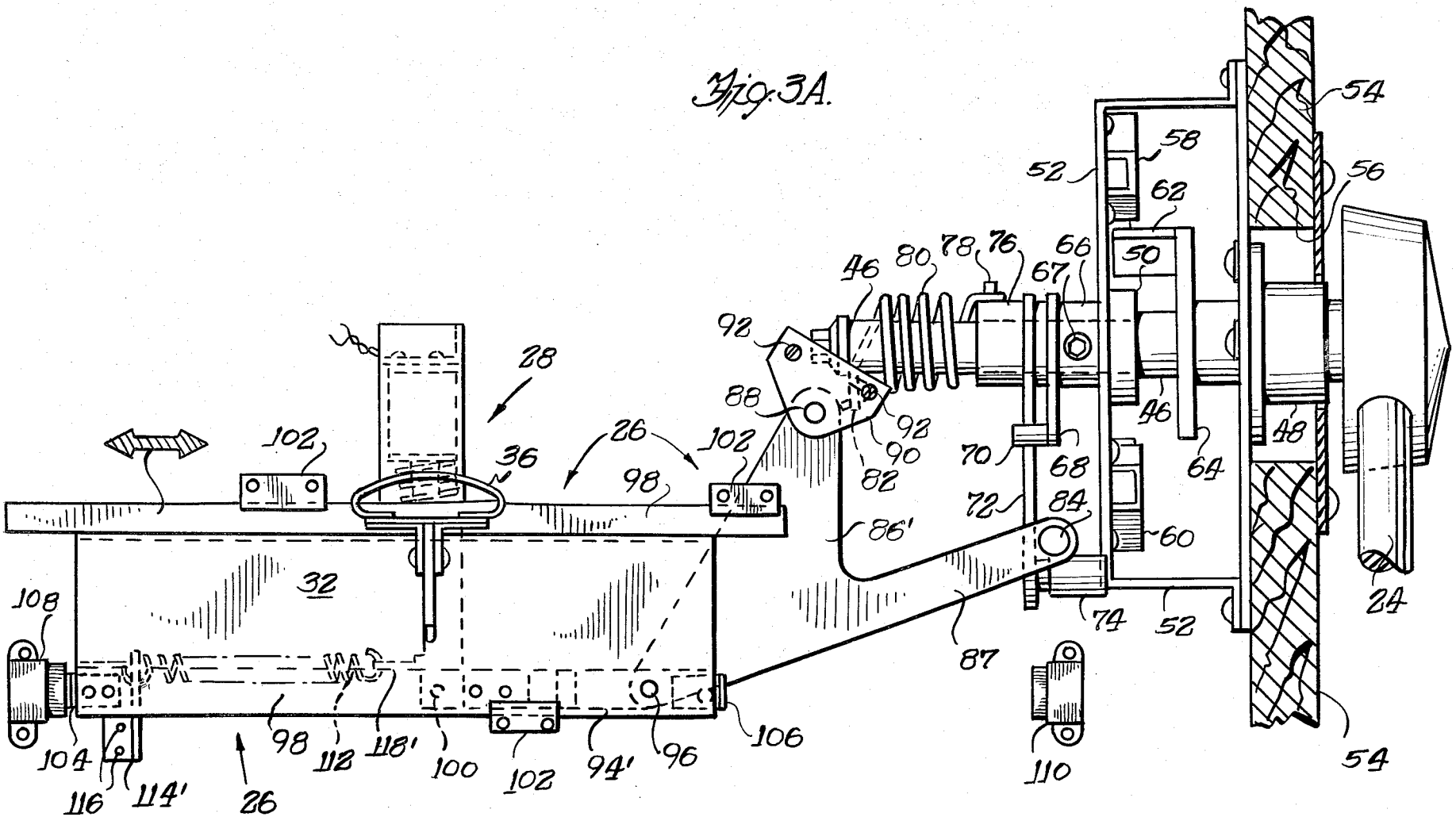
FIG. 3A is a fragmentary plan view of an alternative embodiment to that shown in FIG. 3 and particularly illustrating a mechanism having the operating handle located on the side of the machine.
Figure 4A:
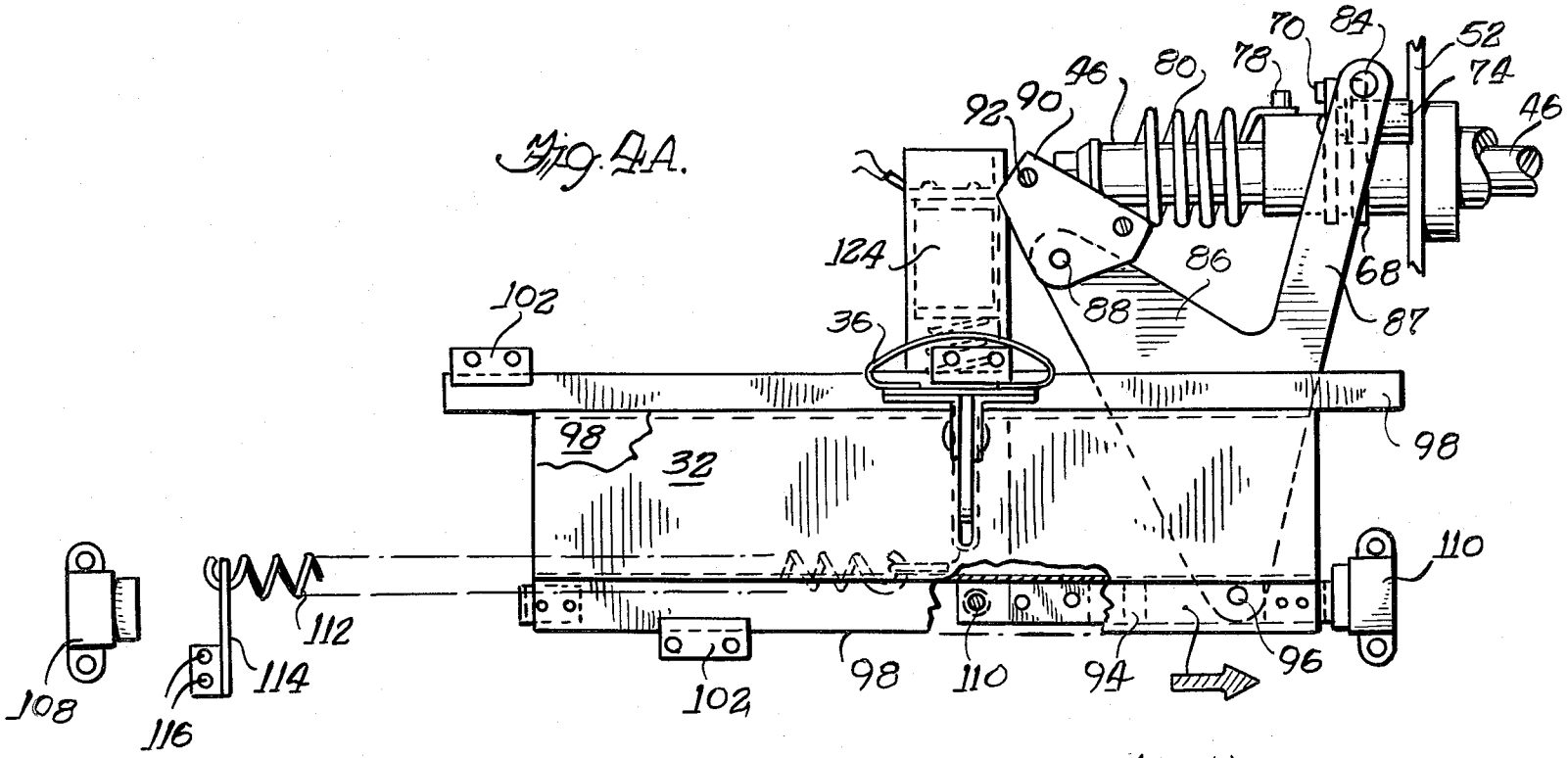
FIG. 4A is a view of a portion of the striking mechanism, similar to FIG. 3A, showing the striking surface in its extreme right position and the operating handle located on the side of the machine.
Figure 5:
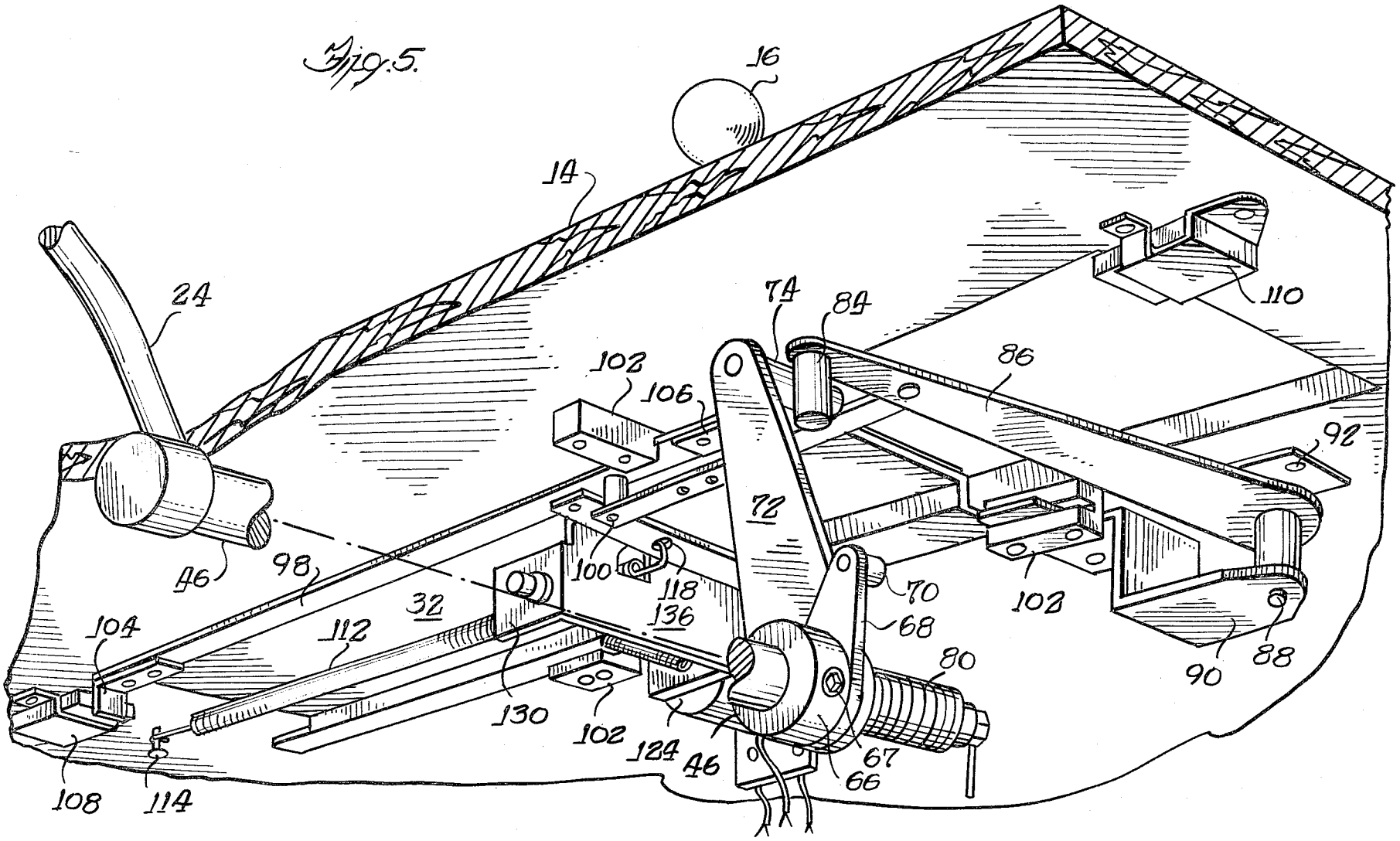
FIG. 5 is a fragmentary perspective view of the mechanism of FIG. 1 as viewed from the underside of the playfield.
Figure 5A:
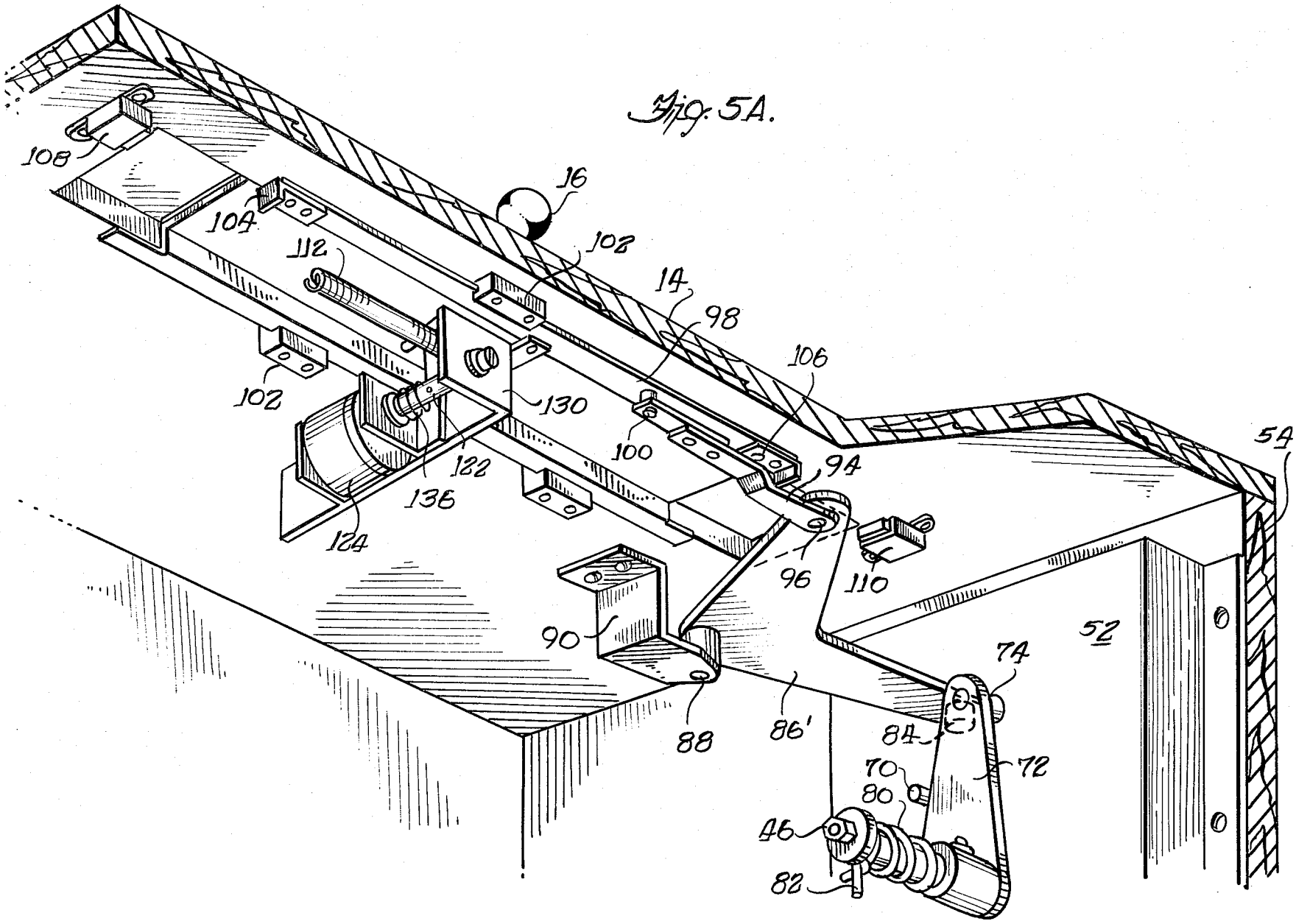
FIG. 5A is a fragmentary perspective view similar to FIG. 5, but illustrating the alternative embodiment shown in FIGS. 3A and 4A with the operating handle on the side of the machine.

While the preferred embodiment has been shown and described, an alternative embodiment which has the handle control mechanism 22 located on the side of the cabinet, rather than the front of the cabinet may be used to control the lateral position of the ball striking mechanism. In this alternative embodiment, the handle control mechanism 22 is substantially identical to that shown and described with respect to the preferred embodiment and for this reason, identical reference numbers are used to identify substantially similar components. The carriage mechanism 26 is also substantially similar to that shown and described with respect to the preferred embodiment, and identical reference numbers are used for that mechanism as well. Where a component has a slightly different shape, its corresponding reference number has been given a prime designation. The views shown in FIGS. 3A, 4A and 5A are substantially similar to those shown in FIGS. 3, 4 and 5, respectively, and the interaction of the handle control mechanism 22 with the carriage mechanism is substantially similar, except that the handle is located to the right of the carriage mechanism in the alternative embodiment whereas it is shown in front of it in the preferred embodiment, all of which is readily apparent by comparing the respective drawings with one another. The significant change relates to the shape of the crank 86′ and the fact that it has a generally transverse extension 87 to which the roller 84 is attached for interacting with the roller 74 of the handle control mechanism 22. The link 94′ attached to an outer end of the crank 86′ by pin 96. The crank 86′ rotates around the pin 88 in response to movement of the handle control mechanism and the interaction of the rollers 74 and 84 provides the left and right sliding movement of the carriage mechanism 26 in response to movement of the handle 24 upwardly and back as shown in FIG. 3A of the drawings. The shock absorbing feature of the handle control mechanism 22 works substantially as that described with respect to the preferred embodiment so that excess energy applied to the handle in either direction is absorbed by the mechanism in a way that will prevent the carriage mechanism from being damaged.

Figure 7F:
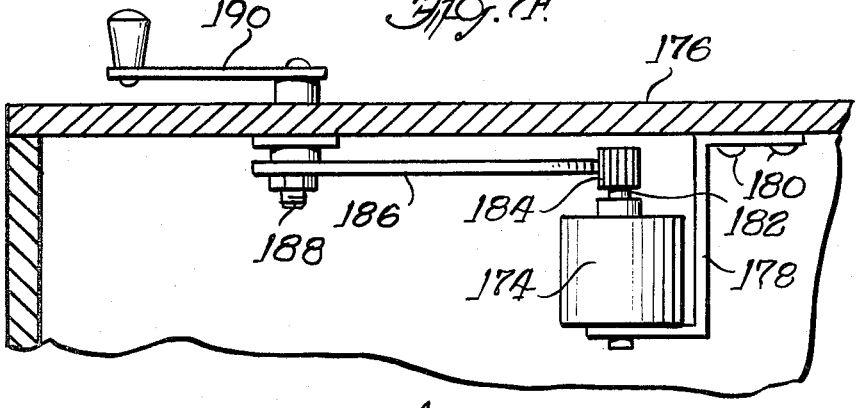
FIG. 7F is a side view of the mechanism shown in FIG. 7E and is taken generally along the line 7F—7F of FIG. 7E.
Figure 7B:
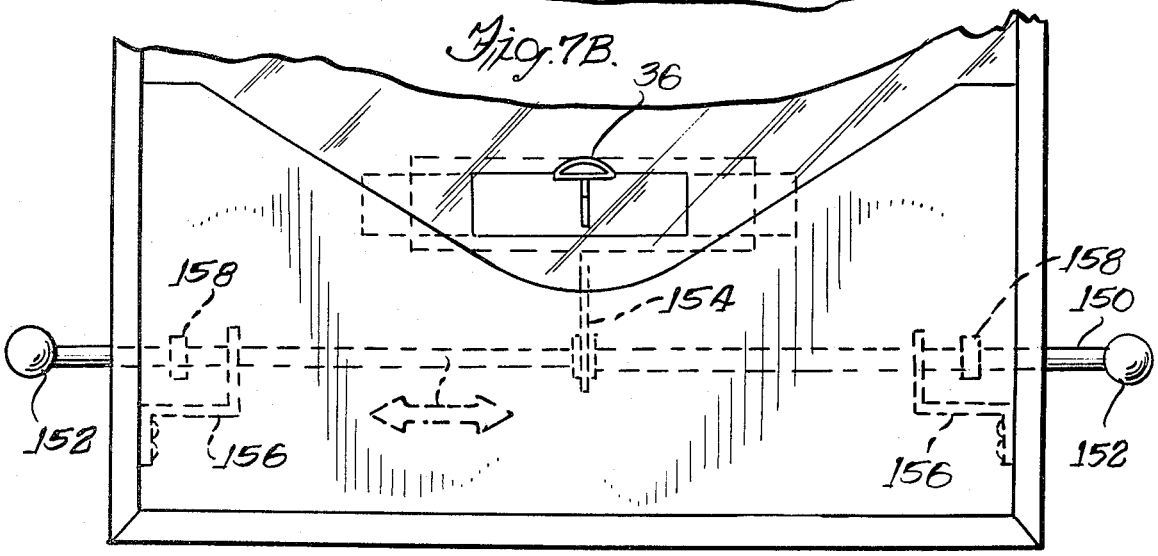
FIG. 7B is a top plan view of an alternate embodiment of a control handle mechanism.

There are other alternative embodiments which also may be utilized to move the carriage mechanism 26, one of which is shown in FIG. 7B. In this alternate embodiment, an elongated handle 150 is provided which extends through the entire width of the cabinet and has knobs 152 which facilitate gripping by a player. It should be appreciated that while the handle is shown to extend from both sides of the cabinet, it may be designed so that the handle is exposed only on one side of the cabinet. The shaft 150 is connected to the carriage mechanism 26 by a bracket 154 so as to directly couple the shaft 150 thereto for laterally moving the same in response to player manipulation. The shaft is mounted for sliding movement in a pair of brackets 156 which are attached to the sides of the cabinet 12 and a pair of rubber stop bumpers 158 are secured to the shaft to limit movement of the shaft 150 between the inside of the cabinet and the abutting surface of the bracket 156.

Figure 7C:
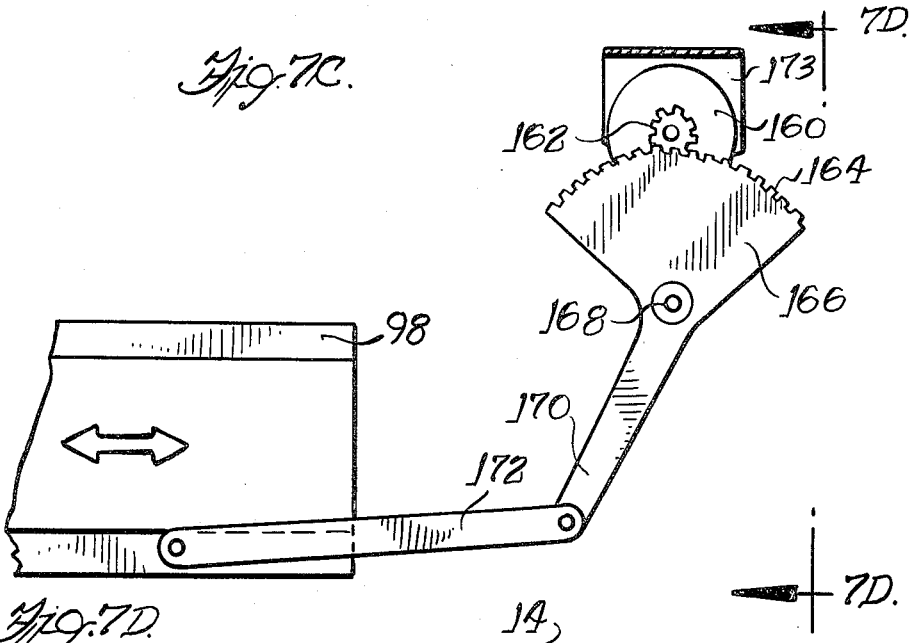
FIG. 7C is a bottom view of yet another alternate embodiment of FIG. 7B of a servo controlled carriage mechanism.
Figure 7D:
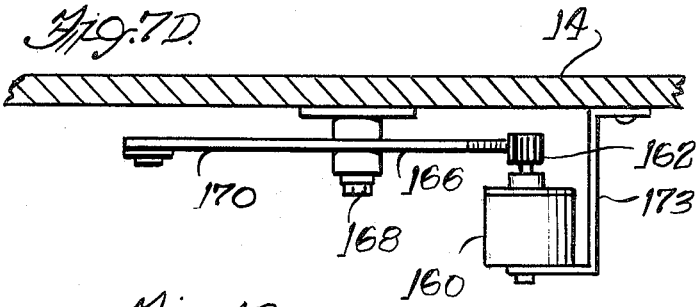
FIG. 7D is a side elevation of the mechanism shown in FIG. 7C taken generally along the line 7D—7D of FIG. 7C.

Another modification of the present invention is shown in FIG. 7C and comprises a servo type control drive mechanism that may be used to control the lateral position of the carriage mechanism 26. In this alternative embodiment, the carriage plate 98 is laterally moved by means of a servo motor 160 having a geared output shaft 162 which engages corresponding teeth 164 of a gear 166 that is pivotable around pivot 168 and has a downwardly extending arm 170 that is attached to a link 172 that has its opposite end attached to the carriage plate 98. The servo motor is mounted to the underside of the playfield by a bracket 173. Thus, when the servo motor is driven in a clockwise direction, the carriage will be moved to the left and when it is driven in the counterclockwise direction, the carriage will be moved to the right. Actuation of the servo motor 160 is controlled by the position of another servo motor 174 shown in FIG. 7F. The servo motor 174 is mounted to the underside of a board 176 by a bracket 178 suitably attached thereto by screws 180 or the like. The servo 174 has a shaft 182 to which a gear 184 is attached and the gear 184 is engaged by a similarly toothed gear 186 that is pivotable about shaft 188 that is controlled by a handle 190 that is adapted for player manipulation. Movement of the handle 190 to the left or right will cause the servo 174 to output a signal that is coupled to the servo motor 160 for producing corresponding rotation of the latter servo.

It is, of course, understood that although preferred embodiments of the present invention have been illustrated and described, various modifications, alternatives and equivalents thereof will become apparent to those skilled in the art, and, accordingly, the scope of the present invention should be defined only by the appended claims and equivalents thereof.

Various features of the present invention are set forth in the following claims.

What is claimed is:

1. In a ball type game apparatus having a sloping playfield adapted to receive a ball thereon such that the ball gravitates toward a lower end of the playfield, the combination therewith comprising:

a carriage mechanism supported for lateral movement between predetermined limit positions relative to the playfield, means biasing said carriage mechanism toward a selected one of said limit positions, a ball striking mechanism carried by said carriage mechanism for lateral movement therewith and extending above said playfield so as to enable engagement with a ball, and control means operatively associated with said carriage mechanism in a manner to enable selective lateral movement thereof, said control means including a player manipulatable actuator, and connecting means interconnecting said player actuator to said carriage mechanisn including a connecting linkage normally engageable with said carriage mechanism so as to effect lateral movement thereof responsive to manipulation of said player actuator, said connecting linkage including means limiting the rate of movement of said carriage mechanism in a first lateral direction responsive to a predetermined rate of movement of said player actuator in a first direction, and being separable from said carriage mechanism so as to be ineffective to control movement of said carriage mechanism in an opposite lateral direction in response to predetermined movement of said player actuator in a direction opposite to said first direction.

2. Apparatus as defined in claim 1, wherein the ball striking mechanism includes a ball striking surface shaped so that the lateral position of the striking surface relative to a ball at the moment of engagement therewith at least partially determines the direction in which the ball will be propelled when engaged by said ball striking surface.

3. Apparatus as defined in claim 2, and in which the striking surface is convex.

4. Apparatus as defined in claim 1 wherein said means limiting the rate of movement of said carriage mechanism in a first lateral direction includes spring means for causing the carriage mechanism to respond to movement of said player actuator so that the maximum acceleration of movement of said striking mechanism is determined by the spring rate of said spring means.

5. Apparatus as defined in claim 1 wherein said carriage mechanism includes a carriage plate member mounted for movement along a predetermined path in said lateral direction.

6. Apparatus as defined in claim 5 further including guides for limiting movement of said carriage plate member to said predetermined path.

7. Apparatus as defined in claim 6 further including at least one stop member positioned adjacent a predetermined end of said predetermined path, said stop member preventing movement of said plate beyond said end of said path.

8. Apparatus as defined in claim 1 wherein said carriage mechanism includes a carriage plate having an upper surface approximately at the elevation of said playfield so that a ball may roll across the carriage plate unimpeded.

9. Apparatus as defined in claim 1 wherein the game apparatus includes a cabinet supporting said playfield, said player actuator comprising a control shaft extending outwardly of said cabinet, and a player operable control lever mounted on said control shaft externally of said cabinet and operative to enable rotation of said control shaft, said connecting linkage including a first arm fixed on said control shaft for rotation therewith, a second arm carried by said control shaft so as to enable relative movement therebetween, spring means interconnected between said control shaft and said second arm so as to bias said second arm in the direction of movement of said control shaft, and means mutually cooperable with said first and second arms so as to effect positive movement of said second arm upon rotation of said control shaft in a first rotational direction but being inoperative to effect movement of said second arm upon rotation of said control shaft in an opposite direction, said second arm being operatively associated with said carriage mechanism such that movement of said control shaft to effect said positive movement of said second arm enables movement of said carriage mechanism solely through said carriage biasing means, while movement of said control shaft in an opposite direction enables movement of said carriage mechanism through said spring means.

10. A ball type game apparatus of the type which has at least one ball and a downwardly sloping playfield, comprising: a carriage mechanism mounted relative to the playfield for movement in a plane generally parallel to the playfield and adapted for lateral movement; a striking mechanism carried by said carriage mechanism and adapted to strike a ball on the playfield and propel it upwardly along the playfield; a first control means operatively associated with said carriage mechanism for selectively moving said carriage and striking mechanisms laterally responsive to a player stimulus; said first control means including a movable handle and a first mechanism operatively coupled to said handle and being movable responsive to movement of said handle, said carriage mechansim being engageable with said first mechanism for translating movement of said handle and first mechanism to lateral movement of said carriage and striking mechanisms; and a second control means for selectively activating said striking mechanism to cause it to move transversely relative to said lateral movement when activated, said transverse movement in a predetermined direction being adapted to strike a ball and propel it upwardly along the playfield in response to a strike stimulus; said first mechanism being biased to normally maintain contact with said carriage mechanism but being separable from said carriage mechanism responsive to a rapid movement above a threshold velocity of said first mechanism in a second direction opposite said first direction.

11. Apparatus as defined in claim 10 further comprising means for biasing said carriage mechanism so as to resiliently urge it against movement in a first lateral direction such that the actual speed of movement of said carriage mechanism is a function of the strength of the biasing means.

12. Apparatus as defined in claim 11 wherein said carriage mechanism includes a carriage plate having an upper surface approximately at the elevation of said playfield so that a ball may roll across said carriage plate unimpeded.

13. Apparatus as defined in claim 10 further comprising a conductive plate positioned in front of said striking mechanism for providing said strike stimulus responsive to detection of said ball in proximity of said conductive plate.

14. Apparatus as defined in claim 13 wherein said conductive plate is mounted atop said playfield with a subtle elevation change opposing the downward slope of the playfield.

15. Apparatus as defined in claim 13 further characterized in that said striking mechanism has a conductive member, wherein said ball is conductive, and wherein said ball contacting said conductive plate and said conductive member of said striking mechanism results in activation of the strike stimulus.

16. Apparatus as defined in claim 15 wherein said conductive member is comprised of a metallic striker extending above and over the playfield.

17. Apparatus as defined in claim 16 wherein said metallic striker has a convex front surface.

18. Apparatus as defined in claim 16 wherein said plate has a slot positioned transverse to the lateral direction of movement, and said metallic striker extends from beneath, up through and above said plate through said slot.

19. Apparatus as defined in claim 10 further characterized in that said player stimulus is comprised of a signal output of a manually actuated switch.

20. A ball type game apparatus of the type which has at least one ball and a downwardly sloping playfield, comprising: a carriage mechanism mounted relative to the playfield for movement in a plane generally parallel to the playfield and adapted for lateral movement; a striking mechanism carried by said carriage mechanism for movement therewith and adapted to strike a ball on the playfield and propel it upwardly along the playfield; a first control means for selectively moving said carriage and striking mechanism laterally responsive to a player stimulus; and a second control means for selectively activating said striking mechanism to cause it to move in the upward sloping direction of the playfield in a path substantially transverse to said lateral movement so as to impart upward motion to a ball when struck by said striking mechanism, said second control means being activated responsive to a strike stimulus; said first control means including first servo motor means adapted for rotation responsive to said player stimulus, second servo motor means adapted for rotation responsive to said first servo motor rotation, and means for translating said second servo motor means rotation to lateral movement of the striking and carriage mechanisms.

21. Apparatus as defined in claim 20 further comprising a pivotable handle for providing said player stimulus.

* * * * *